US006273067B1

(12) United States Patent
Bazinet

(10) Patent No.: US 6,273,067 B1
(45) Date of Patent: Aug. 14, 2001

(54) CONTROL METHOD

(75) Inventor: Vincent Bazinet, Saint Lubin en Vergonnois (FR)

(73) Assignee: Delphi Technologies Incorporated, Troy, MI (US)

( * ) Notice: Subject to any disclaimer, the term of this patent is extended or adjusted under 35 U.S.C. 154(b) by 0 days.

(21) Appl. No.: 09/473,843

(22) Filed: Dec. 28, 1999

(51) Int. Cl.[7] ..... F02M 37/04
(52) U.S. Cl. ..... 123/458; 123/514
(58) Field of Search ..... 123/456, 458, 123/510–11, 514

(56) References Cited

U.S. PATENT DOCUMENTS

| | | | | |
|---|---|---|---|---|
| 5,765,537 | * | 1/2000 | Coleman et al. | 123/514 |
| 5,983,869 | * | 11/1999 | Cooke et al. | 123/514 |
| 6,024,064 | * | 2/2000 | Kato | 123/456 |
| 6,102,010 | * | 8/2000 | Yano | 123/546 |
| 6,131,549 | * | 1/2000 | Onishi | 123/514 |

* cited by examiner

*Primary Examiner*—Thomas N. Moulis
(74) *Attorney, Agent, or Firm*—Wells, St. John, Roberts, Gregory & Matkin, P.S.

(57) ABSTRACT

A control method for controlling the fuel pressure within the common rail or accumulator of a fuel system whilst an associated engine is operating, the fuel system including a plurality of individually actuable fuel injectors arranged to receive fuel from the common rail, each injector including a control valve operable to control the fuel pressure within a control chamber, fuel escaping from the control chamber being returned to a fuel reservoir, the method comprising:

Figure 1:
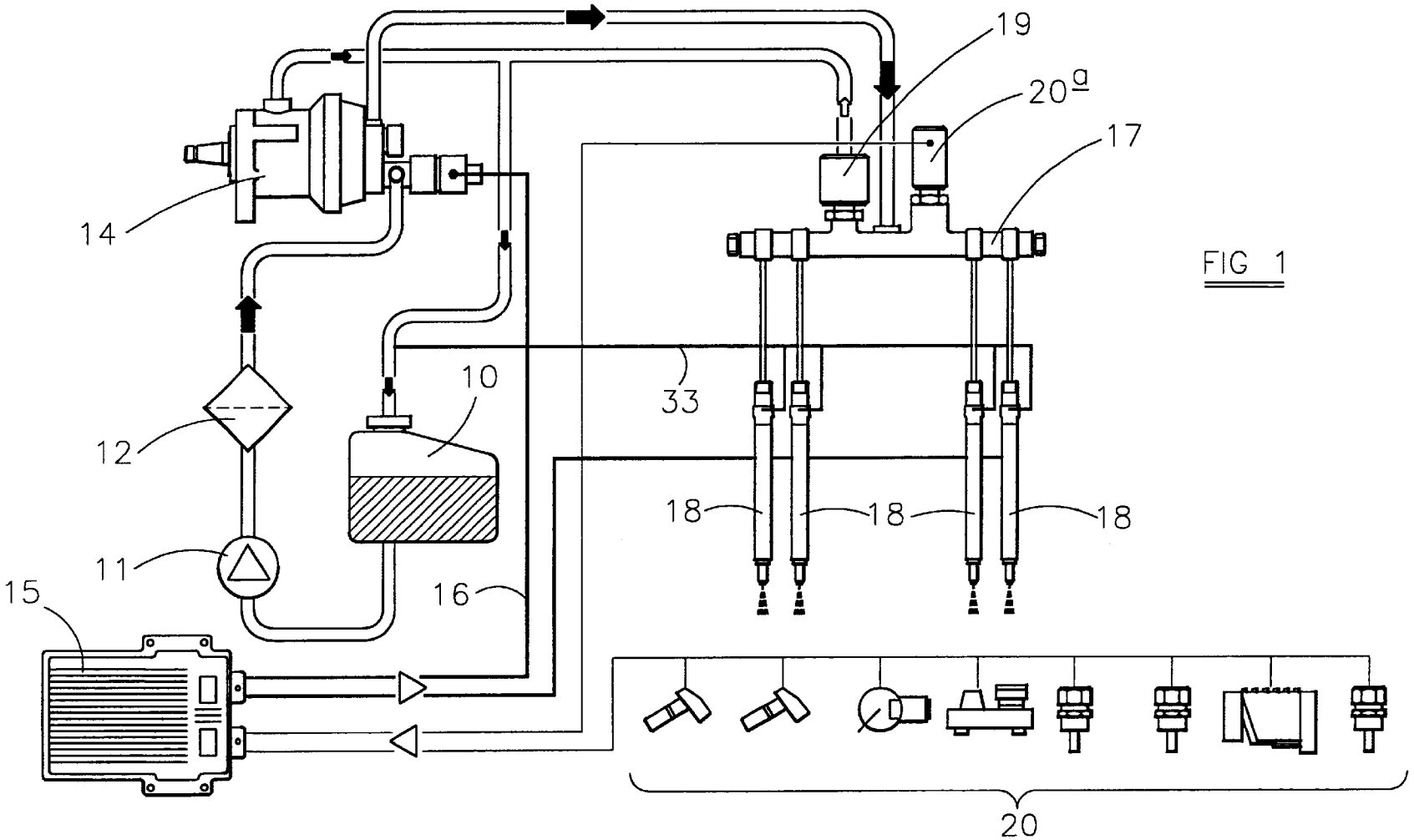

monitoring the fuel pressure within the common rail;

controlling the rate of fuel supply to the common rail; and relieving the common rail fuel pressure in the event that the common rail fuel pressure exceeds a predetermined threshold by actuating the control valve of at least one of the injectors to allow fuel to flow from the common rail, through the control chamber of the injector to the fuel reservoir, the control valve(s) being arranged to control the fuel pressure within the control chamber(s) of the said at least one of the injectors in such a manner as to ensure that injection of fuel through that or those injectors does not commence.

20 Claims, 2 Drawing Sheets

CONTROL METHOD

This invention relates to a control method for use in controlling the operation of a fuel system of the common rail or accumulator type for a compression ignition internal combustion engine. In particular, the invention relates to a control method for use in controlling the fuel pressure within the common rail, in use.

In a known common rail fuel system, a high pressure fuel pump is used to charge a common rail or accumulator with fuel. The fuel pressure within the common rail is controlled by controlling the rate at which fuel is supplied to the high pressure fuel pump using an appropriate metering valve. A pressure limiting valve may be used to prevent the rail pressure exceeding a predetermined threshold for safety purposes.

Such a fuel system operates satisfactorily where the engine is operating at a substantially constant speed against a constant load as the fuel demand is uniform and the metering valve simply needs to be adjusted to supply fuel to the fuel pump at substantially the same rate as fuel is being delivered by the injectors. However, when the engine is not operating in this manner, the metering valve may not be adjusted sufficiently quickly to compensate for changes in the rate of fuel delivery by the injectors thus there may be occasions when the rail pressure exceeds a desired fuel pressure by a significant amount, and it may take a relatively long time for the fuel pressure to fall if the only action taken to correct the fuel pressure is to reduce the rate at which fuel is supplied to the common rail by the fuel pump.

U.S. Pat. No. 5,711,274 describes a method whereby the rail pressure can be relieved, after the engine has been switched off, by supplying control pulses to the control valves of the injectors to permit fuel to be returned to the fuel reservoir without causing the injection of fuel into the cylinders or combustion spaces of the engine. As a result, the provision of a separate pressure relief valve can be avoided.

EP 0896144 describes an arrangement whereby the rail pressure can be relieved, whilst an associated engine is operating, by energising a control valve of one of the injectors, at a time when injection through that injector is not desired, for a period of time sufficient to allow fuel from the rail to escape to a low pressure reservoir through control valve but insufficient to allow injection to commence.

It is an object of the invention to provide a control method whereby, during use of an engine, the fuel pressure within a common rail or accumulator of a fuel system can be controlled.

According to the present invention there is provided a control method for controlling the fuel pressure within the common rail or accumulator of a fuel system whilst an associated engine is operating, the fuel system including a plurality of individually actuable fuel injectors arranged to receive fuel from the common rail, each injector including a control valve operable to control the fuel pressure within a control chamber, fuel escaping from the control chamber being returned to a fuel reservoir, the method comprising:

monitoring the fuel pressure within the common rail;

controlling the rate of fuel supply to the common rail; and relieving the common rail fuel pressure in the event that the common rail fuel pressure exceeds a predetermined threshold by actuating the control valve of at least one of the injectors to allow fuel to flow from the common rail, through the control chamber of the injector to the fuel reservoir, the control valve(s) being arranged to control the fuel pressure within the control chamber(s) of the said at least one of the injectors in such a manner as to ensure that injection of fuel through that or those injectors does not commence.

It will be understood that such an arrangement is advantageous in that if the rail pressure is significantly greater than a desired pressure, the rail pressure can be relieved quickly rather than having to wait for the rail pressure to fall simply by restricting the quantity of fuel supplied to the common rail and waiting for natural leakage of the system to reduce the pressure.

The control method is preferably preceded by a calibration operation during which the duration of maximum control pulse which can be applied to each injector without causing fuel injection is determined. The calibration operation may include the use of an engine mounted accelerometer, the output signal of which can be filtered in such a manner as to permit detection of movement of a needle of each injector. If desired, the calibration operation may be repeated from time to time.

The common rail may be provided with a separate pressure limiting valve for use in the event that the fuel pressure becomes dangerously high.

Preferably, where the control valve(s) are actuated to relieve the rail pressure, the actuation of the control valves is achieved using a relatively low voltage, for example battery voltage. As a result, the valves can be actuated repeatedly in a short space of time, thus permitting a relatively large quantity of fuel to return to the fuel reservoir. A further advantage of using a low voltage source is that the current applied to the control valve(s) is relatively low resulting in the generation of less heat. Although the use of a low voltage is advantageous in that repeated actuation can be achieved within a short period of time without generating excessive heat, it may be possible to achieve repeated actuation of the control valve(s) using higher voltages.

Where a plurality of the control valves are actuated to relieve the common rail fuel pressure, the control valves are conveniently actuated in sequence.

The rate of fuel supply to the common rail may be controlled using a metering valve to control the fuel supply rate to a high pressure pump. Alternatively, a variable displacement fuel pump could be used to charge the common rail.

Figure 2:
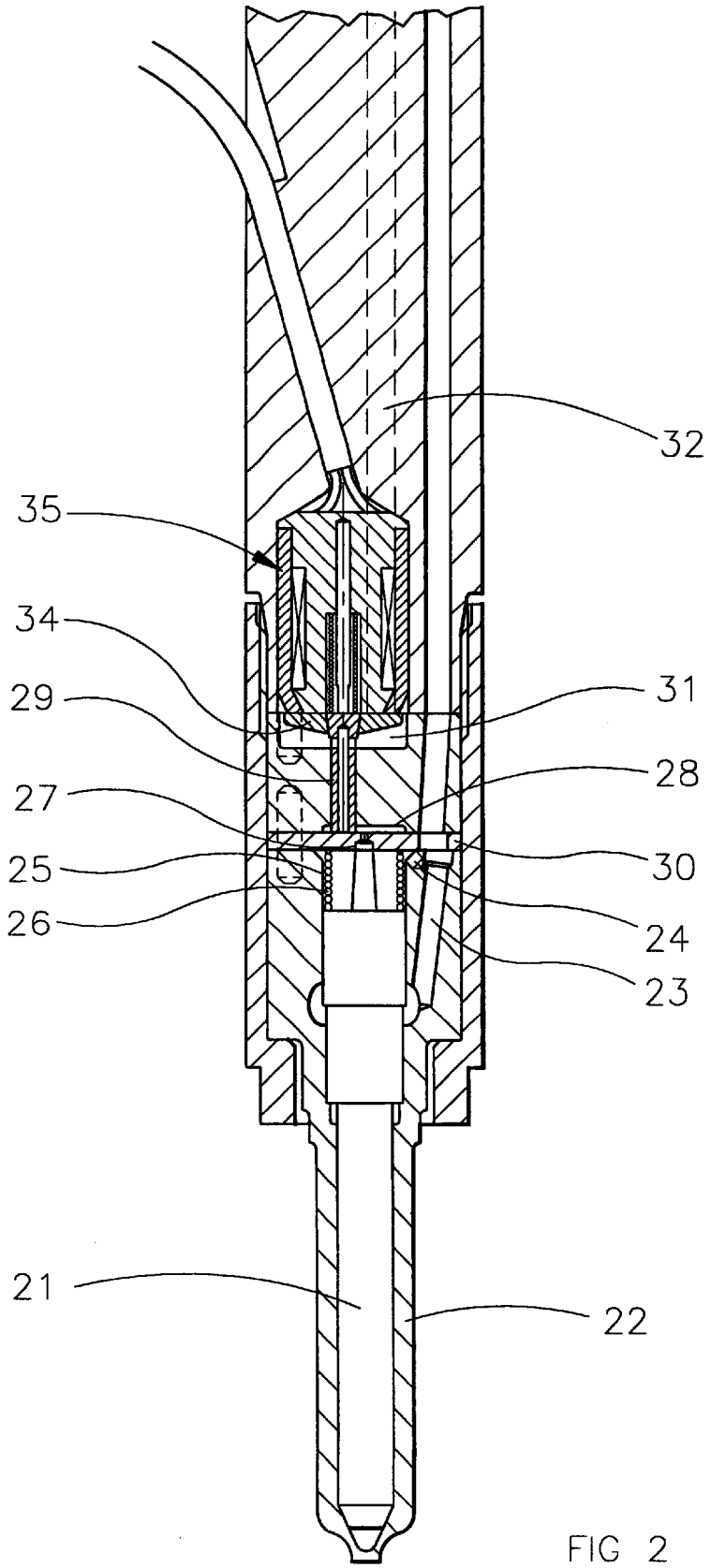

The invention will further be described, by way of example, with reference to the accompanying drawings, in which:

FIG. 1 is a diagram illustrating a fuel system which may be controlled in accordance with a control method of the present invention; and FIG. 2 is a view of an injector suitable for use in the fuel system of FIG. 1.

FIG. 1 illustrates a fuel system for use with an internal combustion engine, the fuel system comprising a fuel reservoir or tank 10 from which fuel is supplied through a low pressure pump 11 and filter 12 to a metering valve 13 provided at the inlet of a high pressure fuel pump 14. The metering valve 13 is of conventional form and is controlled electrically by a controller 15 through a control line 16. The high pressure fuel pump 14 includes a high pressure outlet which communicates with the inlet of a common rail 17. The common rail 17 is connected to a plurality of individually actuable fuel injectors 18. Each of the injectors 18 is arranged to deliver fuel to a respective cylinder of an associated compression ignition internal combustion engine.

The common rail 17 is provided with a mechanical pressure limiting valve 19. The pressure limiting valve 19 operates such that should the fuel pressure within the common rail 17 exceed a maximum threshold, then the valve 19 opens to limit the pressure within the common rail, the fuel escaping from the common rail 17 through the pressure limiting valve 19 being returned to the reservoir 10. The valve 19 acts as a safety valve, avoiding the application of dangerously high pressures to the common rail 17.

The controller 15 is connected to a plurality of sensors 20, the outputs of which provide an indication of the engine operating conditions. As illustrated in FIG. 1, one of the sensors 20 comprises a pressure sensor 20*a* which is arranged to monitor the fuel pressure within the common rail 17. The sensors 20 may also include an engine speed and position sensor, sensors indicative of the air temperature and pressure applied to the cylinders of the engine, and an accelerometer which may be used to sense the commencement of fuel combustion or the commencement of fuel injection.

FIG. 2 illustrates an injector suitable for use in the fuel system of FIG. 1. The fuel injector illustrated in FIG. 2 comprises a valve needle 21 slidable within a bore formed in nozzle body 22. The valve needle 21 is engageable with a seating to control the delivery of fuel by the fuel injector to a combustion space of the associated engine. The bore within which the valve needle 21 is slidable communicates with a fuel supply passage 23 which, in use, communicates with the common rail 17. The passage 23 communicates through a drilling 24 of small diameter with a control chamber 25 defined by an end region of the needle 21, part of the bore within which the needle 21 is reciprocable and a surface of a first distance piece 30, and within which a spring 26 is located, the spring 26 being arranged to apply a force to the needle 21 urging the needle 21 towards its seating. The control chamber 25 communicates through a drilling 27 of small diameter provided in the first distance piece with a chamber 28 defined by a first distance piece 30 and a recess provided in a second distance piece.

A tubular valve member 29 is slidable within a bore provided in the second distance piece, the lower end of the valve member 29 being engageable with a surface of the first distance piece 30, the engagement of the valve member 29 with the distance piece 30 controlling communication between the chamber 28 and a chamber 31 which communicates through a drilling 32 with a backleak or return passage 33 (illustrated in FIG. 1) which communicates with the fuel reservoir 10.

The part of the valve member 29 located within the chamber 31 carries an armature 34 which is moveable under the magnetic field generated, in use, by an electromagnetic actuator 35 which is operable under the control of the controller 15. The actuator 35 includes a spring which urges the valve member 29 into engagement with the first distance piece 30, ensuring that the chamber 28 does not communicate with the reservoir 10 when the actuator 35 is not energised. As a result, fuel is unable to escape from the control chamber 25, and as the control chamber 25 communicates with the supply passage 23, the fuel within the control chamber 25 applies a large magnitude force to the needle 21 assisting the spring 26 in ensuring that the valve needle 21 engages its seating, thus ensuring that fuel injection does not take place.

In use, when injection is to commence, the actuator 35 is energized to lift the valve member 29 away from the first distance piece 30. As a result, fuel from the control chamber 25 is able to escape to the chamber 28 and along the passage defined by the valve member 29 to the chamber 31. The chamber 31 communicates with the fuel reservoir 10 as discussed hereinbefore, and so the fuel escaping from the control chamber 25 is returned to the reservoir 10. It will be appreciated that such operation of the actuator 35 results in the fuel pressure within the control chamber 25 falling, the rate at which fuel can flow to the control chamber 25 from the passage 23 being restricted by the drilling 24 of small diameter. The magnitude of the force urging the needle 21 towards its seating is thus reduced, and a point will be reached beyond which the fuel pressure acting upon appropriately orientated thrust surfaces of the needle 21 will be able to lift the needle 21 away from its seating. Injection thus commences.

When injection is to be terminated, the actuator 35 is de-energized and the valve member 29 returns under the action of the spring of the actuator 35 into engagement with the first distance piece 30. As a result, fuel is no longer able to escape from the control chamber 25 to the reservoir 10 and the continued communication between the control chamber 25 and the passage 23 results in the fuel pressure within the control chamber 25 rising. The increased fuel pressure within the control chamber 25 results in the magnitude of the force applied to the needle 21 urging the needle 21 towards its seating increasing, and a point will be reached beyond which the needle 21 is returned into engagement with its seating thus terminating injection.

Having briefly described the operation of the fuel injector illustrated in FIG. 2, the operation of the fuel system of FIG. 1 will be described.

Fuel is supplied to the fuel pump 14 at a rate governed by the metering valve 13, and the setting of the metering valve is selected in response to the various control signals applied to the controller 15. Fuel from the high pressure fuel pump 14 is supplied to the common rail 17. It is desirable to supply fuel to the common rail 17 at substantially the rate at which it is being delivered by the fuel injectors 18 to maintain the common rail 17 at a substantially constant fuel pressure and the metering valve 13 is controlled accordingly. However, it has been found that maintaining the fuel pressure within the common rail 17 at a substantially uniform level, in use, simply by varying the quantity of fuel supplied to the pump 14 through the metering valve 13 is not always satisfactory as there may be a significant time lag between the time at which a reduction in the rate at which fuel is delivered to the engine occurs and the corresponding reduction occurring in the rate at which fuel is supplied to the high pressure fuel pump 14. As a result, the fuel pressure within the common rail 17 may rise above a desired level.

In accordance with the invention, when the fuel pressure within the common rail 17 is close to the desired level, the rail pressure is controlled using the metering valve 13 to control the rate at which fuel is supplied to the common rail. Upon sensing that the fuel pressure within the common rail 17 has risen above a predetermined level, the actuators 35 of the injectors 18 which are not being used to deliver fuel to the combustion engine at a given instant are energized, in sequence, to lift the valve members 29 thereof away from the first distance pieces 30. As a result, fuel is permitted to escape from the control chambers 25 of those injectors 18. The energization of the actuators 34 occurs for a sufficiently short period of time that the fuel pressure within each control chamber 25 does not fall to a sufficiently low level to allow movement of the associated valve needles 21 to occur. It will thus be appreciated that although the energization of the actuators 34 permits fuel to escape from the control chambers 25 of those injectors 18, injection of fuel through those injectors 18 to the cylinders of the associated engine does not take place.

In each case, after de-energization of the actuators 35, the continued flow of fuel through the drillings 24 will repressurize the control chambers 25. Clearly, as energization of the actuators 34 permits fuel from the control chambers 25 to flow to the low pressure fuel reservoir 10, and as the control chambers 25 are replenished from the common rail 17, it will be appreciated that the energisation and de-energisation of the actuators 34 allows the fuel pressure within the common rail 17 to be relieved without causing injection of fuel.

The operation of energising and de-energising the actuators of the injectors not being used for fuel delivery is repeated until the common rail pressure falls to an acceptable level, after which the rail pressure is controlled using the metering valve.

The desired fuel pressure level may be a fixed level or may vary depending upon engine operating conditions, for example engine speed and load. Similarly, the threshold beyond which the injectors are used to relieve the common rail pressure may be fixed or may vary with engine operating conditions.

It is envisaged that the actuators 35 of the injectors 18 could be energized using a low voltage supply, for example a 12 volt battery voltage, when the energization of the actuators 35 is being used to relieve the common rail fuel pressure. As a result of using the low battery voltage for energization of the actuators 35, the actuators 35 can be energized repeatedly in a short space of time to permit a significant level of fuel to escape from the common rail 17 to the fuel reservoir 10 without resulting in the generation of significant heat levels within the injectors 18. The selected actuator(s) are conveniently energised at a sufficiently high rate that several energisation operations occur during the time that another of the injectors completes one injection cycle. Such operation may be difficult to achieve if higher voltages were used.

It is envisaged that prior to use, a calibration operation is undertaken to permit determination of the maximum duration of the drive pulse which can be applied to each actuator 35 without causing injection of fuel. Such a calibration may involve the detection of start of combustion using an accelerometer or in-cylinder pressure sensors, or the use of injector needle movement sensors. Clearly, once this information is known for each injector, then during subsequent use of the fuel system, when the fuel pressure within the common rail is to be relieved by repeatedly energizing and de-energizing the actuators of various of the injectors, the actuators 35 of each injector can be controlled in such a manner as to ensure that injection does not take place. If desired, the calibration operation may be repeated from time to time, for example during maintenance or servicing of the fuel system. It will be appreciated, however, that if desired the calibration operation may be omitted.

The fuel system described hereinbefore may be modified in a number of ways. For example, the injectors need not be of the type described hereinbefore and may, if desired, be arranged such that the control valve controls communication between the supply passage and the control chamber, the control chamber being in constant communication with the fuel reservoir.

What is claimed is:

1. A control method for controlling a fuel pressure within a common rail or accumulator of a fuel system whilst an associated engine is operating, the fuel system including a plurality of individually actuable fuel injectors arranged to receive fuel from the common rail, each injector including a control valve operable to control a fuel pressure within a control chamber, fuel escaping from the control chamber being returned to a fuel reservoir, the method comprising:

monitoring the fuel pressure within the common rail;

controlling a rate of fuel supply to the common rail; and relieving the common rail fuel pressure in the event that the common rail fuel pressure exceeds a predetermined threshold by actuating the control valve of at least one of the injectors to allow fuel to flow from the common rail, through the control chamber(s) of the at least one of the injectors to the fuel reservoir, the control valve(s) being arranged to control the fuel pressure within the control chamber(s) of the said at least one of the injectors in such a manner as to ensure that injection of fuel through that or those injectors does not commence, further comprising a calibration operation during which the maximum duration of a control pulse which can be applied to each injector without causing fuel injection is determined, the calibration operation including the use of at least one engine mounted accelerometer, the output signal of which is filtered to permit detection of movement of a needle of each injector.

2. A method as claimed in claim 1, wherein the common rail is provided with a separate pressure limiting valve.

3. A method as claimed in claim 1, wherein, where the control valve(s) is actuated to relieve the rail pressure, the actuation of the control valves is achieved using a relatively low voltage.

4. A method as claimed in claim 3, wherein the relatively low voltage is battery voltage.

5. A method as claimed in claim 1, wherein, when the rail pressure is to be relieved, at least one of the control valves is actuated repeatedly in a short space of time.

6. A method as claimed in claim 5, wherein the at least one of the control valves is actuated several times during a complete injection cycle of another of the injectors.

7. A method as claimed in claim 4, wherein, when the rail pressure is to be relieved, at least one of the control valves is actuated repeatedly in a short space of time.

8. A method as claimed in claim 7, wherein the at least one of the control valves is actuated several times during a complete injection cycle of another of the injectors.

9. A method as claimed in claim 1, wherein, when the rail pressure is to be relieved, a plurality of the control valves are actuated to relieve the common rail fuel pressure.

10. A method as claimed in claim 9, wherein the control valves are actuated in sequence.

11. A method as claimed in claim 1, wherein the rate of fuel supply to the common rail is controlled using a metering valve to control the fuel supply rate to a high pressure pump.

12. A method as claimed in claim 1, wherein a variable displacement fuel pump is used to charge the common rail.

13. A control method for controlling a fuel pressure within a common rail or accumulator of a fuel system whilst an associated engine is operating, the fuel system including a plurality of individually actuable fuel injectors arranged to receive fuel from the common rail, each injector including a control valve operable to control a fuel pressure within a control chamber, fuel escaping from the control chamber being returned to a fuel reservoir, the method comprising:

monitoring the fuel pressure within the common rail;

controlling a rate of fuel supply to the common rail; and relieving the common rail fuel pressure in the event that the common rail fuel pressure exceeds a predetermined threshold by actuating the control valve of at least one of the injectors to allow fuel to flow from the common rail, through the control chamber(s) of the at least one of the injectors to the fuel reservoir, the control valve(s) being arranged to control the fuel pressure within the control chamber(s) of the said at least one of the injectors in such a manner as to ensure that injection of fuel through that or those injectors does not commence, wherein the actuation of the control valve(s) to relieve the rail pressure is achieved using battery voltage so as to avoid the generation of excessive heat levels within the injector(s).

14. A method as claimed in claim 13, wherein the common rail is provided with a separate pressure limiting valve.

15. A method as claimed in claim 13, wherein, when the rail pressure is to be relieved, at least one of the control valves is actuated repeatedly in a short space of time.

16. A method as claimed in claim 15, wherein the at least one of the control valves is actuated several times during a complete injection cycle of another of the injectors.

17. A method as claimed in claim 13, wherein, when the rail pressure is to be relieved, a plurality of the control valves are actuated to relieve the common rail fuel pressure.

18. A method as claimed in claim 17, wherein the control valves are actuated in sequence.

19. A method as claimed in claim 13, wherein the rate of fuel supply to the common rail is controlled using a metering valve to control the fuel supply rate to a high pressure pump.

20. A method as claimed in claim 13, wherein variable displacement fuel pump is used to charge the common rail.

* * * * *